United States Patent [19]

Winey

[11] Patent Number: 4,480,155

[45] Date of Patent: Oct. 30, 1984

[54] DIAPHRAGM TYPE MAGNETIC TRANSDUCER

[75] Inventor: James M. Winey, White Bear Lake, Minn.

[73] Assignee: Magnepan, Inc., White Bear Lake, Minn.

[21] Appl. No.: 353,847

[22] Filed: Mar. 1, 1982

[51] Int. Cl.[3] ..... H04R 9/00

[52] U.S. Cl. ..... 179/115.5 PV

[58] Field of Search ..... 179/115.5 PV, 115 R, 179/115 V, 114 R, 117

[56] References Cited

U.S. PATENT DOCUMENTS

| | | | |
|---|---|---|---|
| 3,674,946 | 7/1972 | Winey | 179/115.5 PV |
| 3,829,623 | 8/1974 | Willis | 179/115.5 PV |
| 3,833,771 | 9/1974 | Collinson | 179/115.5 PV |
| 3,922,502 | 11/1975 | Tabuchi | 179/115.5 PV |
| 3,922,503 | 11/1975 | Tabuchi | 179/115.5 PV |
| 4,242,541 | 12/1980 | Ando | 179/115.5 PV |

FOREIGN PATENT DOCUMENTS

| | | | |
|---|---|---|---|
| 456570 | 4/1926 | Fed. Rep. of Germany | 179/115.5 PV |
| 2461258 | 1/1976 | Fed. Rep. of Germany | 179/115.5 PV |
| 52-20013 | 2/1977 | Japan | 179/115.5 PV |
| 52-38915 | 3/1977 | Japan | 179/115.5 PV |
| 52-43419 | 4/1977 | Japan | 179/115.5 PV |
| 57-65996 | 4/1982 | Japan | 179/115.5 PV |
| 1443491 | 7/1976 | United Kingdom | 179/115.5 PV |

OTHER PUBLICATIONS

S. Rich, "Electrodynamic Loudspeaker . . . ", *Electronics*, Jun. 1961.

G. Aisberg, et al., "Flat Voice Code . . . ", Radio-Electronics, Jan. 1962, pp. 63–64.

*Primary Examiner*—Gene Z. Rubinson

*Assistant Examiner*—L. C. Schroeder

*Attorney, Agent, or Firm*—Peterson, Palmatier, Sturm, Sjoquist & Baker, Ltd.

[57] ABSTRACT

A diaphragm type magnetic speaker with conductor runs on the diaphragm, the conductor runs having a multiplicity of conductors arranged in a band in each run which confronts portions of two magnetized strips with front faces of opposite polarity and the space between such magnetized strips. The width of the band of conductors exceeds the width of the space between adjacent magnet strips and traverses the entire transverse portions of both of the adjacent magnetized strips from which the magnetic field for the conductor run emanates.

11 Claims, 10 Drawing Figures

DIAPHRAGM TYPE MAGNETIC TRANSDUCER

This invention relates to diaphragm type magnetic speakers.

BACKGROUND OF THE INVENTION

Diaphragm type magnetic transducers incorporate three basic components including a diaphragm, a magnetic backing, and conductors affixed on the diaphragm. The magnetic backing is magnetized in long zones or strips in a direction perpendicular to the diaphragm which confronts the magnetic backing. This arrangement of magnetizing the magnetic backing produces magnetic pole faces confronting the diaphragm and spaced from each other. Adjacent pole faces of opposite polarity produce magnetic fields which embrace portions of the diaphragm. A number or runs of the signal carrying conductors are arranged to extend along the pole faces of the magnetic backing and in the individual magnetic fields to produce the vibration of the diaphragm when an audio signal current is applied to the conductor runs. Transducers of this type are illustrated in U.S. Pat. Nos. 3,674,946 and 3,919,499.

The magnetic backing of such transducers usually includes an apertured soft iron armature plate upon which a magnet is laid. The magnet has taken the form of an apertured sheet of magnetic material which define such long magnetized zones and such pole faces. In many instances, it has been more efficient to form the magnet in a multiplicity of elongate magnetized strips laid on the soft iron armature plate in spaced relation to each other. Each such strip defines one long magnet with a pole face confronting the diaphragm and cooperating with an adjacent magnetized strip to define the magnetic field which embraces an adjacent conductor run on the diaphragm.

In such transducers, the conductor runs on the diaphragm lie along and confront the spaces adjacent the magnetized strips. Although such conductor runs have been known to include several individual conductors or strands, the runs of conductors have mainly confronted the spaces between the magnet strips, where the maximum depth of magnetic field, measured perpendicular from the pole faces, is located.

SUMMARY OF THE INVENTION

An object of the invention is to provide an improved planar diaphragm type magnetic speaker which provides improved efficiency and provides a high degree control of the diaphragm by actually driving a significantly greater proportion of the diaphragm.

A feature of the present invention is the provision of conductors in wide bands covering nearly 100% of the diaphragm area. The band of conductors in each conductor run confronts both the space between adjacent magnetized strips and also confronts substantially the entire front faces of the magnet strips adjoining the space and providing the field which embraces the conductor run. The band of conductors may be tightly clustered, or the conductors in each band may be spaced slightly from each other. Adjacent conductor runs may be spaced from each other or may be arranged without appreciable space therebetween. Conductors on the diaphragm may be round wires, or may be flat and formed of metal foil or deposited metal partially etched away into separate conductors.

The magnetic fields are in long zones, along magnetized strips of opposite polarity. The space between the long magnetic fields is narrow, and the conductor runs are spaced from each other only by the same narrow space.

Wide conductor bands as described are particularly useful on diaphragms in transducers with magnetic field sources on both sides of the diaphragm. In this arrangement where magnetic pole faces of like polarity confront each other with the conductors in between, the magnetic fields, or the lines of magnetic flux are configured to obtain maximum driving and controlling the diaphragm. In this arrangement, the lines of magnetic flux from both magnetic field sources lie parallel to the diaphragm and perpendicular to the conductors, resulting in application of forces against all of the conductors and the entire diaphragm in a direction perpendicular to the diaphragm as desired among magnetic circuits producing wide based magnetic fields.

The principle advantage of the invention is that the efficiency of the transducer is significantly increased, and that there is increased diaphragm control providing improved frequency response.

A BRIEF DESCRIPTION OF THE DRAWINGS

FIG. 1 is an elevation view of a speaker embodying the present invention.

DETAILED SPECIFICATION

Figure 2:
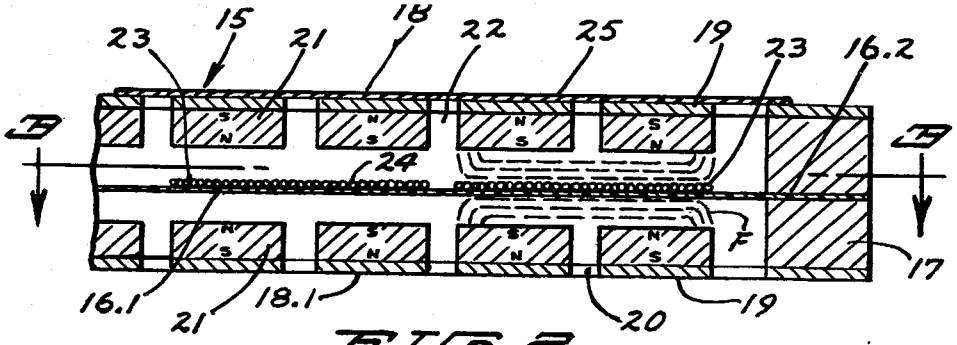
FIG. 2 is an enlarged detail section view taken at 2—2 in FIG. 1.

One form of the invention is illustrated in detail in FIGS. 1–4 wherein the transducer 15 has a diaphragm 16 with a vibratable area 16.1 and peripheral area 16.2 which is affixed as by adhesives to a peripheral rigid frame and spacer strip 17.

The transducer 15 may exist in a wide range of sizes and shapes and may be rectangular in a size range of forty to sixty inches or more long by twelve or more inches wide, or may be relatively wide; or the transducer may be oblong or round, as small as three inches in diameter or smaller. Also the diaphragm may have two or more vibratable areas.

The diaphragm 16 as illustrated is formed of a flexible film type plastic, such as Mylar, a trademark of DuPont. The diaphragm may be stretched very tight, or in some instances, may be relatively loose, with such tautness as to remove wrinkles. Otherwise, the diaphragm may be stiff or substantially rigid as more specifically illustrated in FIG. 8.

The transducer 15 also includes two identical substantially rigid magnetic backings 18 and 18.1 at opposite sides of the diaphragm 16 and confronting each other. Each of the magnetic backings has a soft iron armature plate 19 with a multiplicity of apertures 20 therein for making the magnetic backing acoustically transparent.

The magnetic backings 18 and 18.1 also include a multiplicity of elongate magnetized strips 21 which are laid on the plates 19 and between the apertures 20 thereof. The magnetized strips extend longitudinally of the elongate transducer and substantially throughout the entire length thereof. The elongate magnetized strips may be made of any of a number of materials. One typical material is a rubber bonded barium ferrite material sold under its trademark "Plastiform", by 3M Company, St. Paul, Minn. The magnet strips may also be formed of other magnetic type materials such as ceramic magnets or some of the rare earth magnets.

Figure 3:
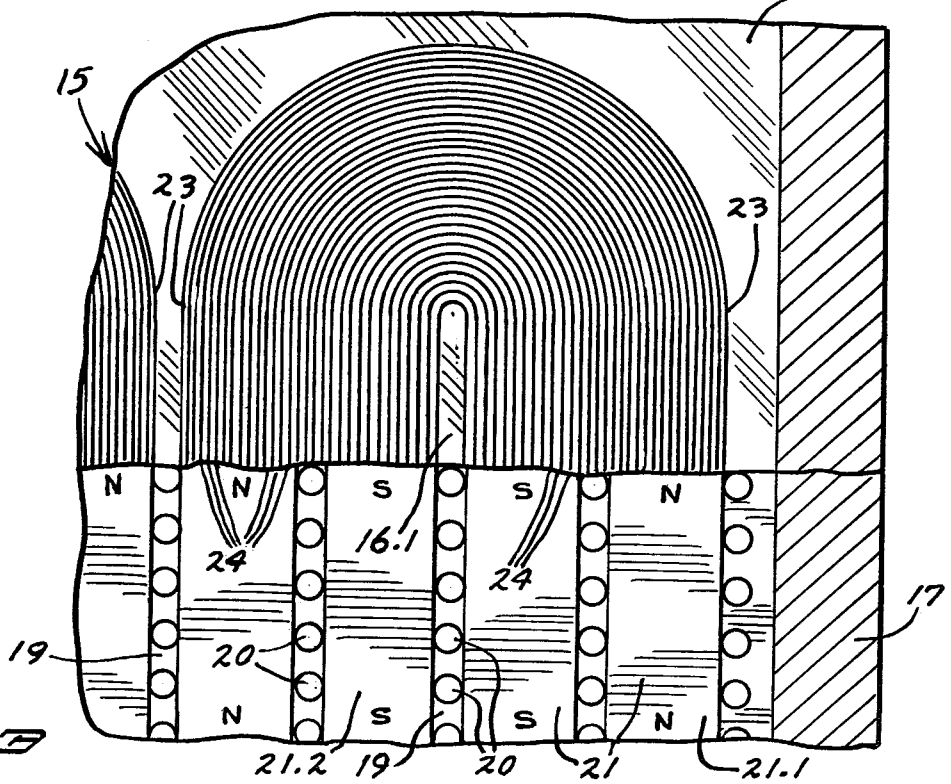
FIG. 3 is an enlarged detail section view, taken at 3—3 of FIG. 2 and partially broken away for clarity of detail.

The magnetized strips 21 in FIGS. 1–3 are cut from large sheets of magnetic material and are laid on the plate 19 and magnetically secured thereon. The magnetized strips are magnetized in a direction perpendicular to the diaphragm 16 so that their front faces define pole faces of various polarities north and south. The north polarity front faces are designated 21.1 and the south polarity front faces are designated 21.2. Other magnetic circuits may also be used in the magnetic backing 18, such as the magnetic circuit more fully illustrated in FIG. 6. Each magnetized strip 21 is directly opposite another magnet strip 21 of like polarity in the other magnetic backing.

The magnetized strips 21 are located on the plate 19 so that there are spaces 22 therebetween. As indicated in FIG. 2, the adjacent magnetized strips having front faces of opposite polarity produce magnetic fields, indicated by the dotted lines F, which project from the magnetized strips to the diaphragm 16. Because of the opposing magnetized strips of like polarity, the magnetic fields and magnetic lines of flux lie parallel to the diaphragm, as illustrated.

The transducer 15 also includes a multiplicity of conductor runs 23 adhesively secured on the diaphragm 16 and lying in spaced and parallel relation to each other throughout substantially the entire length and breadth of the vibratable area 16.1 of the diaphragm.

Each conductor run 23 comprises a wide band of individual conductors 24 which, as seen in FIGS. 2 and 3, are tightly clustered together so that each strand or conductor 14 adjoins the next adjacent strand with no appreciable space therebetween. In this form, there is a slight space 25 between adjoining runs 23 or between the adjacent wide bands of conductors of the adjacent runs.

It is evident in FIGS. 2 and 3 that the edges of the bands of conductors are directly opposite the sides of the magnet strips. In this transducer with two magnetic backings 18, 18.1 confronting each other, the sides of each magnetic field are nearly perpendicular to the faces of the magnet, but taper slightly convergently away from the magnet face; and each magnetic field lies parallel to the diaphragm, between its slightly converging sides. The band of conductors has a width essentially the same as the width of the effective portion of the magnetic field, that is the portion which lies parallel to the diaphragm and which is effective to produce forces on the diaphragm and conductor run in a direction perpendicular to the diaphragm when a signal current is applied to the conductors. The band of conductors traverses the space between two magnet strips of opposite polarity; however, the space between two magnet strips of like polarity has no magnetic field, and therefore, the width of the space between adjacent conductor bands is about the same as the width of said space between the magnet strips of like polarity.

The effective portion of the magnetic field and lines of flux lie parallel to the diaphragm and to the conductor band. The forces generated by signal current in the conductors are therefore perpendicular to the diaphragm and conductors, as desired, to produce maximum vibration and control of the diaphragm for producing the desired sounds.

Figure 7:
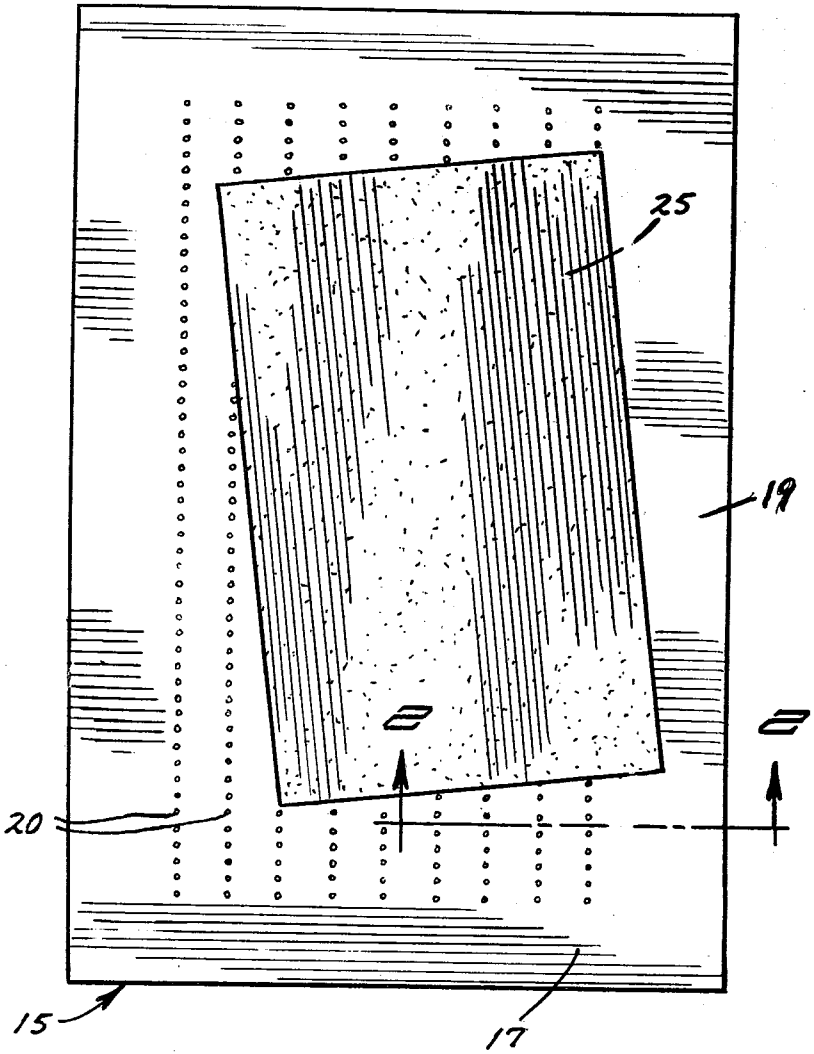
FIG. 7 is a detail section view of another modified form of the invention.
Figure 5:
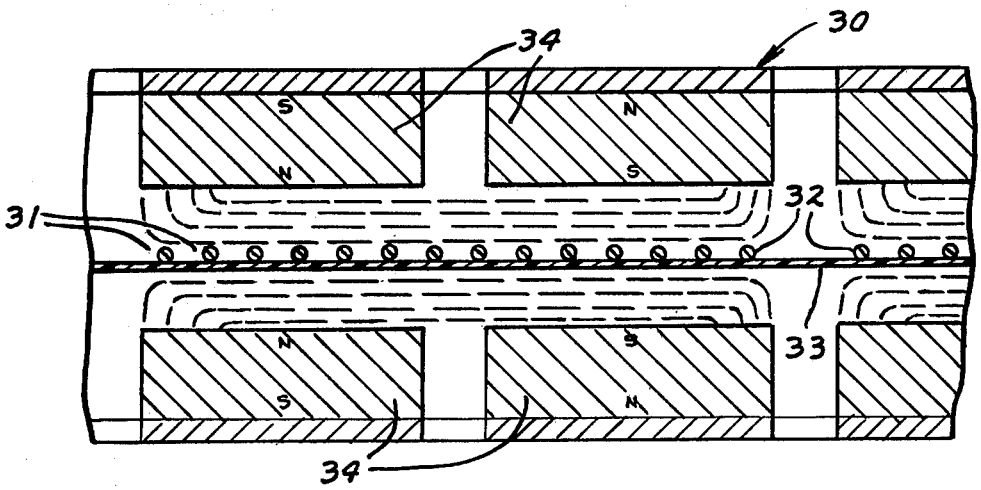
FIG. 5 is a detail section view of a modified form of the invention.
Figure 6:
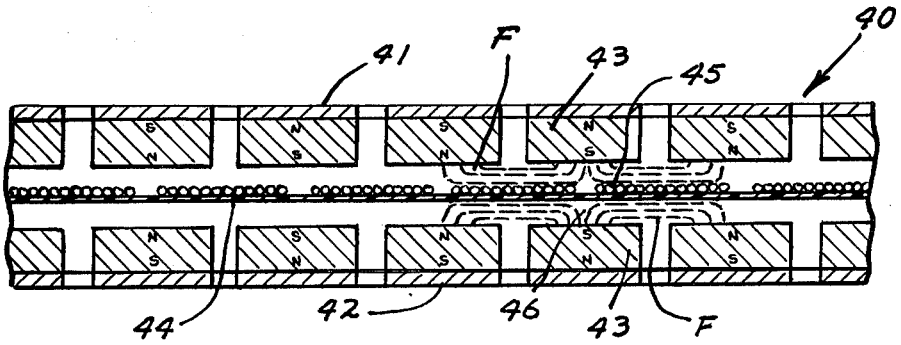
FIG. 6 is a detail section view of another modified form of the invention.
Figure 7:
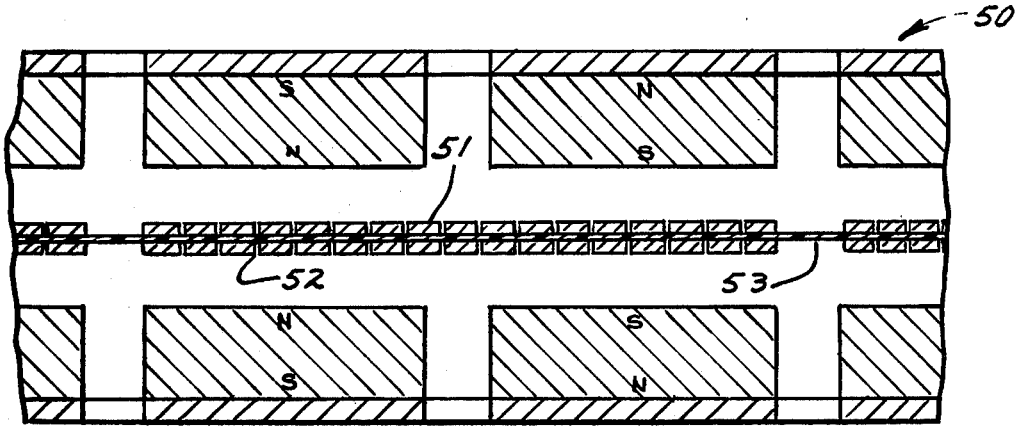

The conductors 24 may be round wire, as illustrated in FIGS. 2, 5, and 6, or may be foil, or metal film deposited on the film and etched away as seen in FIG. 7. Wire size gauge may be within a wide range, for instance, twenty gauge aluminum or smaller. Conductor sizes in foil or metal deposited on the diaphragm should have comparable cross sectional areas as the wire sizes mentioned. Foils may typically be one half mil to ten mil thickness, more or less.

In this arrangement illustrated in FIGS. 1–4, magnetized strips 21 are arranged in functional pairs with opposite polarities at their front faces. The strips adjacent each other but not in the same functional pair are of like polarity at their front faces. Accordingly, each conductor band traverses essentially the entire front faces of the magnetized strips of a funcational pair and the space therebetween.

In FIGS. 1 and 2, a thin sheet or panel 25 of tissue paper, similar to bathroom tissue or facial tissue, is adhesively secured to the outside face of the soft iron plate 19 of the magnetic backing 18. The sheet of tissue 25 obstructs a number of the apertures 20 and provides a limited acoustical loading to the diaphragm 16. This acoustical loading may be varied by the size of the panel 25 and has the effect of providing a limitation on the movement of the diaphragm to minimize the likelihood of the diaphragm bottoming or slapping against the magnet faces.

Figure 4:
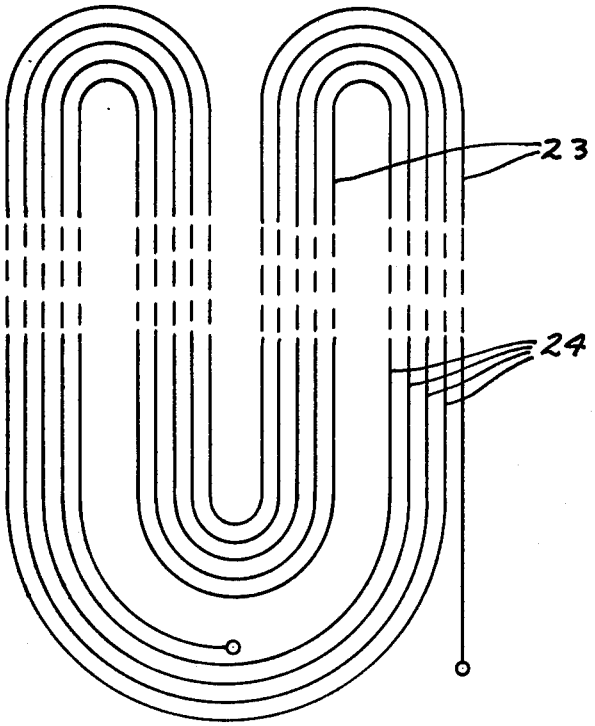
FIG. 4 is a diagrammatic illustration of one arrangement of conductors on the diaphragm.

FIG. 4 illustrates one arrangement of conductor strands 24 in the several runs 23. The magnetized strips extend only along the straight portions of the runs. It will be seen that this configuration is suitable for a printed circuit (or etched) strands which do not need to cross each other.

In operation, it has been found that the arrangement of the conductor runs with the conductors in wide bands which overlap and confront the entire faces of the magnet strips, produce an improved control of the diaphragm of the speaker or transducer so as to obtain substantially improved frequency response. Also, there is an increased efficiency in the transducer.

In the form of the invention illustrated in FIG. 5, the transducer 30 is very similar to that of FIGS. 1–4. The difference in this transducer is that the individual strands 31 in the conductor runs 32 are spaced from each other instead of lying next to each other and in engagement with each other as illustrated in FIGS. 2 and 3. The strands are adhesively secured to the diaphragm 33, but are spaced slightly apart. FIG. 5, being in an enlarged scale as compared to FIG. 2, clearly illustrates the approximate shape of the magnetic fields produced by the functional pairs of magnetized strips 34 at opposite sides of the diaphragm.

In FIG. 5, the spacing between the adjacent runs 32 of conductors on the diaphragm at least slightly exceeds the spacing between the individual conductor strands 31 in the run.

In FIG. 6, the transducer 40 is again very similar to the transducer 15 of FIGS. 1–4 with the exception that the magnetic circuit in the magnetic backings 41 and 42 is slightly different. In this form of the invention, adjacent magnet strips 43 have opposite polarities at their front faces and alternate magnet strips have like polarities at their front faces. Again, as in FIGS. 1–3, because the magnet strips in the opposite magnetic backings 41 and 42 confront magnet strips of like polarity, the effective portions magnetic fields created and the lines of magnetic flux are substantially flat and parallel to the diaphragm 44, although the sides of the magnetic fields are slightly tapered.

It will be recognized that in this form, each magnetic field F has a width which traverses only half the width of the faces of adjacent magnet strips of opposite polarity; and the width of the band 45 of conductors is the same as the width of the effective portion of the field which lies parallel to the diaphragm. At approximately the location indicated by number 46, between two adjacent fields F and approximately half way across the width of each of the magnet strips, there is a narrow space of minimum magnetic field, and accordingly, a space is left between adjacent conductor runs 45 opposite this space 46. In the transducer 40 although the conductor runs have the same width as the effective portions of the magnetic fields F, there will be very slightly less percent of the diaphragm which is covered by conductor runs as compared to the transducer 15 of FIGS. 1–3.

In the form of transducer illustrated in FIG. 7, the transducer 50 is substantially the same as that illustrated in FIGS. 1–4 with the exception that the transducer 50 has the conductors 51 and 52 formed of foil or metal deposited on the faces of the diaphragm 53. The foil or deposited metal is slightly etched away to form individual strands insulated from each other by means of a simple space. The space between adjacent conductors will have a width in the same order of magnitude as the thickness of the foil. The conductor runs are arranged similarly to those of FIGS. 1–3, but may also be arranged similarly to those in transducer 40 of FIG. 6. The arrangement of conductors as illustrated in FIG. 4 is important to FIG. 7 in order to minimize the likelihood of the need to cross one conductor over another.

Figure 8:
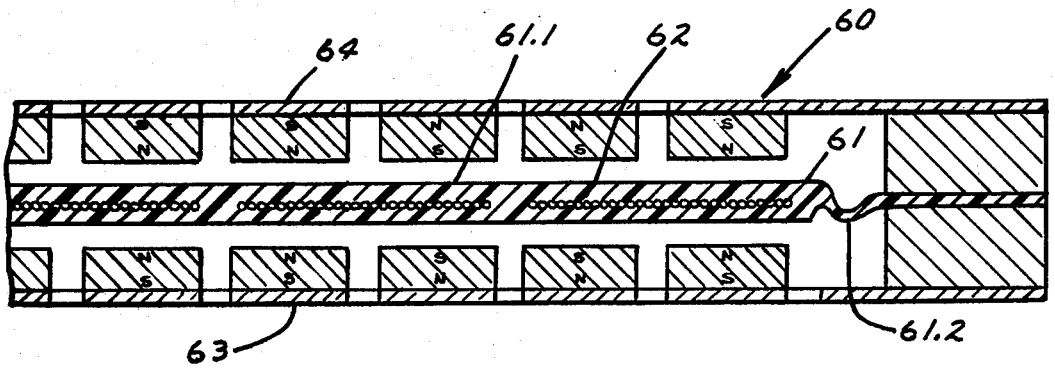
FIG. 8 is a detail section view of still another modified form of the invention.

In the transducer 60 of FIG. 8, the transducer is substantially the same as that illustrated in FIGS. 1–4, which the exception that in this form, the diaphragm 61 has a vibratable area 61.1 which is stiff or substantially rigid, being formed of materials such as styrofoam which may be honeycombed or other similar stiff type material. The vibratable area of the diaphragm has conductor runs 62 embedded therein, or otherwise affixed to the stiff vibratable area of the diaphragm. The diaphragm also has a flexible connection or surround 61.2 connecting the stiff vibratable area to the peripheral area which is clamped to the magnetic backings 63 and 64 of the transducer. All portions of the vibratable area 61.1 will move with substantially the same movement, and remain substantially planar during such movement. Accordingly, the diaphragm has a piston-like action rather than the flexing action of the diaphragm in FIGS. 1–3.

Figure 9:
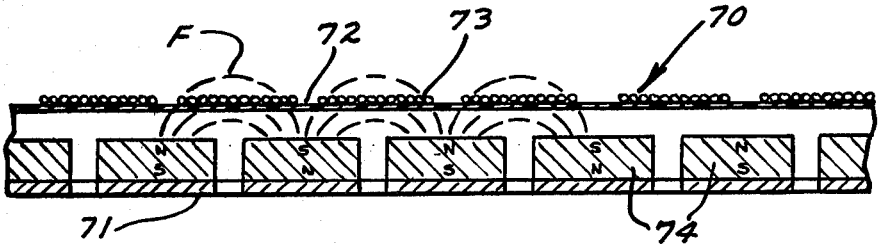
FIG. 9 is a detail section view of still another modified form of the invention.

In the form of the transducer 70 illustrated in FIG. 9, the transducer is constructed with the magnetic backing 71 only on one side of the diaphragm 72. In many instances, depending upon the overall size of the transducer, this arrangement is satisfactory for producing sufficient sound output. Again, in this form, the conductor runs 73 traverse essentially the entire width of the magnetic fields which intersect the diaphragm and are produced by the magnetized strips 74. The magnetic field or lines of flux F in the transducer 70 have a slighty different rounded shape, and slightly less force on the conductors carrying signal currents, because there is no opposite magnetic backing as in FIGS. 1–3 to create the flattened effect upon the magnetic field. Again, the broad bands of conductors in the conductor 73 provide substantial control on the diaphragm and increase the frequency of response thereof.

Figure 10:
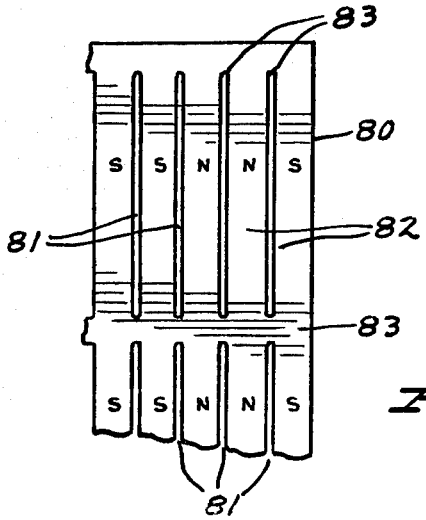
FIG. 10 is a detail plan view of an alternate form of magnet sheet which may be substituted for the strips illustrated in the other views.

FIG. 10 illustrates a modified form of magnet structure which may be used in any of the disclosed forms of transducer. The magnet structure 80 is in sheet or panel form and may be molded or die cut to the shape illustrated. The magnet structure is formed of the same material as described for strips 21 of FIGS. 1–3. A number of slots 81 are formed to define spaces between the magnetized strips 82. The slots will align with the apertures in the iron or steel panel of the magnetic backing. Narrow bridges 83 traverse the slots and interconnect adjacent strips 82. The magnetized strips may be magnetized with magnetic poles at their front faces as indicated or otherwise according to the magnetic circuit desired.

It will be seen that the improved transducer according to this invention utilizes the wide bands of conductors to cover substantially the entire face of the diaphragm to produce a substantially increased control on the diaphragm and increase the frequency response thereof. Practically no portion of the diaphragm is without close control on its movement.

What is claimed is:

1. An audio frequency signal current carrying transducer, comprising a diaphragm having a vibratable area, a pair of magnetic backings connected with the diaphragm in confronting and spaced relation to each other and respectively on opposite sides of the diaphragm, each of said magnetic backings having an armature plate with a multiplicity of elongate magnetized strips spaced from each other and magnetized in a direction transverse to the diaphragm and having elongate front faces defining pole faces confronting the diaphragm, the pole faces of each magnet strip being opposite to and confronting a magnetized strip of like polarity in the opposite magnetic backing, the pole faces of adjacent magnetized strips and of opposite polarities producing elongate magnetic fields projecting toward the diaphragm, adjacent magnetic fields being separate and distinct from each other, and a multiplicity of signal current carrying conductor runs on the diaphragm and confronting adjacent magnetized strips of opposite polarities and the spaces therebetween of both magnetic backings, the discrete conductors in each run adjoining each other and covering the entire diaphragm along the run and asserting full control of the diaphragm, the conductors in each run being arranged in a wide band traversing the width of the magnetic field projecting to the diaphragm, there being a narrow space between adjacent wide band conductor runs to maintain such adjacent runs separate and distinct in embraced relation to the respective separate and distinct magnetic fields.

2. The transducer according to claim 1 and the diaphragm being flexible and flexing under influence of the signal current cooperating with the magnetic fields.

3. The transducer according to claim 1 and the vibratable area of the diaphragm being stiff and resisting flexing.

4. The transducer according to claim 1 and the conductors having strands of round wire.

5. The transducer according to claim 1 and the conductors in the runs being in flat strands lying on the diaphragm.

6. The transducer according to claim 1 and the conductor runs being located on the surface of the diaphragm.

7. The transducer according to claim 1 and the conductor runs being embedded in the diaphragm.

8. The transducer according to claim 1 and the width of the vibratable area of the diaphragm being entirely covered with conductor runs, but for said spaces maintaining the runs in separate and distinct magnetic fields.

9. An audio frequency signal current carrying transducer, comprising a diaphragm having a vibratable area, a magnetic backing connected with the diaphragm in confronting and spaced relation with the diaphragm, said magnetic backing having an armature plate with a multiplicity of elongate side by side magnets laid thereon, the elongate magnets being spaced from each other and magnetized in a direction transverse to the diaphragm and having elongate front faces defining pole faces confronting the diaphragm, the pole faces of adjacent magnets being of opposite polarities and producing elongate magnetic fields projecting toward the diaphragm, the adjacent magnets having a sequence of polarities at their front faces as follows, to wit: north, south, south, north, north, south, et seq., each magnetic field traversing entirely across adjacent pole faces of opposite polarity, and a multiplicity of signal current carrying conductor runs on the diaphragm and confronting adjacent magnets of opposite polarities and the spaces therebetween of both magnetic backings, the discrete conductors in each run adjoining each other and covering the entire diaphragm along the run and being arranged in a wide band with a width spanning across the width of a pair of said magnet pole faces and across the space between adjacent magnets to traverse the entire magnetic field at the diaphragm for asserting full control of the diaphragm.

10. A transducer according to claim 9 wherein the armature plate is of soft iron and the magnets are permanent magnets entirely to the pole faces thereof.

11. A transducer according to claim 9 and there being a second magnetic backing on the opposite side of the diaphragm from said first mentioned magnetic backing and being substantially identical with said first mentioned magnetic backing, the pole face of each magnet confronting a pole face in the opposite magnetic backing of like polarity, one of said magnetic backings being apertured for passage of air and sound as the diaphragm vibrates under influence of a signal applied to the conductor runs.

* * * * *